US012649595B1

(12) United States Patent
Jiang et al.

(10) Patent No.: US 12,649,595 B1
(45) Date of Patent: Jun. 9, 2026

(54) CONVENIENT MEAL BOX SEALING MACHINE FOR USE

(71) Applicant: Jinguan Zheng, Wenzhou (CN)

(72) Inventors: Jisuo Jiang, Wenzhou (CN); Heji Wen, Wenzhou (CN); Pengfei Yu, Ruian (CN); Chaoqi Yu, Ruian (CN); Jifan Jiang, Wenzhou (CN); Qiang Wang, Wenzhou (CN)

(73) Assignee: Jinguan Zheng, Wenzhou (CN)

( * ) Notice: Subject to any disclaimer, the term of this patent is extended or adjusted under 35 U.S.C. 154(b) by 0 days.

(21) Appl. No.: 19/396,721

(22) Filed: Nov. 21, 2025

(30) Foreign Application Priority Data

Oct. 22, 2025 (CN) ..... 202522234475.3

(51) Int. Cl.
*B65B 7/16* (2006.01)
*B65B 61/06* (2006.01)

(52) U.S. Cl.
CPC ..... *B65B 7/164* (2013.01); *B65B 61/06* (2013.01)

(58) Field of Classification Search
CPC ..... B65B 7/164; B65B 61/06; B65B 31/028; B65B 7/2878; B29C 65/224
See application file for complete search history.

(56) References Cited

U.S. PATENT DOCUMENTS 5,718,101 A * 2/1998 Noel ..... B65B 61/10 53/442
10,443,918 B2 * 10/2019 Li ..... F25D 3/08
11,655,094 B2 * 5/2023 Eilerts ..... A47J 47/14 220/592.03
2012/0324835 A1 * 12/2012 Ickert ..... B29C 66/92445 53/329
2013/0118117 A1 * 5/2013 Grobbel ..... B29C 65/48 53/329.2
2015/0259086 A1 * 9/2015 Ahn ..... B65B 7/164 53/329.3
2018/0346167 A1 * 12/2018 Capriotti ..... B65B 7/164
2019/0062032 A1 * 2/2019 Mader ..... B29C 66/131
2019/0135463 A1 * 5/2019 Noda ..... B29C 53/02
2019/0185188 A1 * 6/2019 Palumbo ..... B65B 61/06
2020/0346802 A1 * 11/2020 Mader ..... B65B 51/10
2021/0171229 A1 * 6/2021 Thurig ..... B65B 5/068
2021/0171230 A1 * 6/2021 Palumbo ..... B65B 11/52
2021/0292019 A1 * 9/2021 Chevalier ..... B65B 7/164
2021/0380287 A1 * 12/2021 Candida ..... B65B 5/02
2022/0009669 A1 * 1/2022 Mack ..... B65B 7/164
2025/0019102 A1 * 1/2025 Mondini ..... B65B 7/164

* cited by examiner

*Primary Examiner* — Himchan Song
(74) *Attorney, Agent, or Firm* — Birchwood IP

(57) ABSTRACT

A convenient meal box sealing machine is provided, which includes a machine body. A top of the machine body is provided with a sealing groove, and a left side of the sealing groove is provided with a sealing film groove. A middle of the sealing groove is provided with a meal box groove, and a top of the sealing film groove is provided with a film cutting component. A top of the machine body is rotatably connected to a sealing cover, and an inner side of the sealing cover is provided with a through groove. The through groove is communicated to an interior of the sealing cover, and a sealing plate is slidably connected in the through groove. Two connection blocks are fixedly connected on four sides of the sealing plate, and the connection blocks penetrate and are slidably connected to a limit column.

9 Claims, 3 Drawing Sheets

CONVENIENT MEAL BOX SEALING MACHINE FOR USE

CROSS-REFERENCE TO RELATED APPLICATIONS

This application claims priority to Chinese Patent Application No. 202522234475.3, filed on Oct. 22, 2025, which is hereby incorporated by reference in its entirety.

TECHNICAL FIELD

The present disclosure relates to the field of sealing machine technologies, and in particular, to a convenient meal box sealing machine for use.

BACKGROUND

Sealing machine refers to a mechanical device that seals a packaging container after it contains products. Home food is no longer limited to "freshly made and eaten" but has emerged with new scenarios such as "pre-packaged food storage", "leftover food packaging", "secondary sealing of takeaway meal boxes", and "ingredient preservation by parts". For example, office workers will prepare a week's worth of lunch in advance and need to seal the meal box to prevent cross contamination. If leftover food from a family dinner is directly covered with plastic wrap, it is prone to spoilage due to poor sealing. However, a sealing machine can achieve tight sealing of the meal box and extend the shelf life.

Most of the existing meal box sealing machines are suitable for food processing in restaurants or other catering industries, with prices ranging from several thousand RMB. They are not suitable for small households, and traditional cling film and lids have problems such as incomplete sealing and easy bacterial growth.

To address the above issues, a convenient meal box sealing machine is proposed.

SUMMARY

The purpose of this application is to provide a convenient meal box sealing machine, which solves problems of existing meal box sealing machines in the background technology, which are mostly suitable for food processing in restaurants or other catering industries, with prices ranging from several thousand RMB, and are not suitable for small households. Besides that, traditional cling films and cling caps have problems such as incomplete sealing and easy bacterial growth.

To achieve the above objectives, the present application provides the following technical solution: a convenient meal box sealing machine, including: a machine body, where a top of the machine body is provided with a sealing groove, a left side of the sealing groove is provided with a sealing film groove, a middle of the sealing groove is provided with a meal box groove, and a top of the sealing film groove is provided with a film cutting component; a top of the machine body is rotatably connected to a sealing cover, and an inner side of the sealing cover is provided with a through groove; the through groove is communicated to an interior of the sealing cover; the through groove is slidably connected to a sealing plate, and four sides of the sealing plate are fixedly connected to connection blocks; the connection blocks penetrate and are slidably connected to a limit column, a bottom of the limit column is fixedly connected to an inner wall of the sealing cover, and a top of the limit column is fixedly connected with a gasket, and an outer side of the sealing plate is fixedly connected with a sealing plate silicone; an outer side of the sealing plate is fixedly connected with a heating wire, an outer side of the heating wire is provided with a high-temperature adhesive tape, and the high-temperature adhesive tape is fixedly connected to the sealing plate; an outer side of the sealing cover is provided with an expansion groove, and a push block is connected inside the expansion groove; an inner side of the sealing cover is provided with a slotting; the slotting is communicated to the expansion slot, and a clamp block is inserted and provided inside the slotting, and the clamp block is fixedly connected to the push block.

By adopting the above technical solution, the sealing plate and the heating wire on the outside of the sealing plate are divided into two types: wide-voltage heating wire and high-voltage heating wire. An input voltage of the wide-voltage heating wire is 12V, and an input voltage of the high-voltage heating wire is 100-240V. It can achieve two sealing ways: preheating sealing and direct sealing. The two heating wires have the same shape and are both in the shape that fits a heat-sealed edge of the meal box.

In some embodiments of the present disclosure, the film cutting component includes a movable cover, and the movable cover is rotatably connected to a left side of the sealing groove, a movable groove is penetrated and provided inside the movable cover; a sliding seat is slidably connected inside the movable groove, and a blade is fixedly connected to a bottom of the sliding seat.

By adopting the above technical solution, the film cutting component can facilitate linear cutting of the sealing film covering the top of the meal box.

In some embodiments of the present disclosure, an outer side of the through groove is provided with a protruding ring, and the protruding ring is fixedly connected to the sealing cover.

By adopting the above technical solution, the sealing film can be limited by the protruding ring when the sealing cover is closed.

In some embodiments of the present disclosure, a first spring is sleeved above an outer side of the limit column, and the first spring is provided between the connection blocks and the gasket.

By adopting the above technical solution, the sealing plate can move up and down through the contraction of the first spring, resulting in better sealing effect on the meal box.

In some embodiments of the present disclosure, an outer side of the meal box groove is provided with a meal box support silicone, and the meal box support silicone is fixedly connected to the sealing groove.

By adopting the above technical solution, the meal box support silicone can provide support and limit to edges of the meal box.

In some embodiments of the present disclosure, a sealing clip is fixedly connected to a right side of the sealing groove.

By adopting the above technical solution, the sealing film can be limited by the sealing clip.

In some embodiments of the present disclosure, a second spring is fixedly connected to an inner side of the push block, and the second spring is fixedly connected to an inner wall of the expansion groove.

By adopting the above technical solution, the expansion and contraction of the push block can be achieved through the second spring.

In some embodiments of the present disclosure, a clamp slot is provided at a front end of the sealing slot, and the clamp slot corresponds to the clamp block.

By adopting the above technical solution, the sealing cover can be firmly locked to the machine body through the combination of the clamp block and the clamp slot, avoiding accidental opening of the sealing cover during a sealing process and affecting the sealing effect.

Compared with existing technologies, the beneficial effects of this application are as follows.

The present application provides a convenient meal box sealing machine, which is divided into two types: wide-voltage heating wire and high-voltage heating wire through the sealing plate and the heating wire on the outside of the sealing plate. The input voltage of the wide-voltage heating wire is 12V, and the input voltage of the high-voltage heating wire is 100-240V. It can achieve preheating sealing and direct sealing in two sealing ways, and with the first spring compressed and contracted, it can realize the up and down movement of the sealing plate within the through groove, which has a better sealing effect on the meal box. It can be easily cut linearly with the film cutting component covering the meal box, and the sealing machine is compact, simple and easy to operate, suitable for small households.

Figure 1:
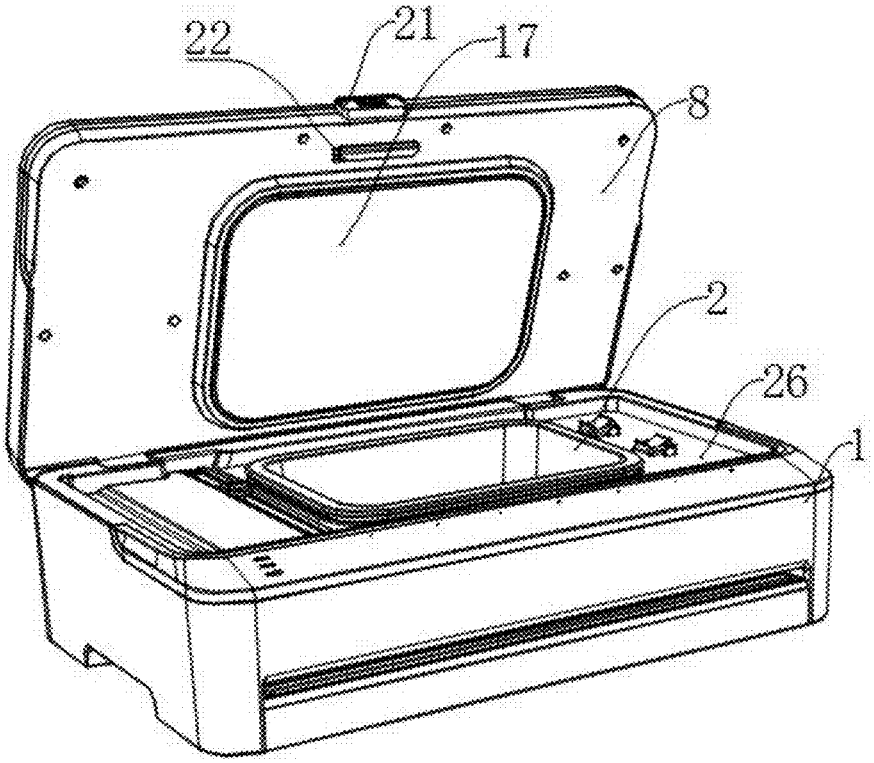
FIG. 1 is a schematic diagram of an overall structure of the present application.

Numeral reference: 1—machine body; 2—meal box groove; 3—sealing film groove; 4—movable cover; 5—movable groove; 6—sliding seat; 7—blade; 8—sealing cover; 9—protruding ring; 10—through groove; 11—sealing plate; 12—connection block; 13—limit column; 14—first spring; 15—sealing plate silicone; 16—heating wire; 17—high temperature adhesive tape; 18—meal box support silicone; 19—sealing clip; 20—expansion groove; 21—push block; 22—clamp block; 23—slotting; 24—second spring; 25—clamp slot; 26—sealing groove.

DESCRIPTION OF EMBODIMENTS

Below, the technical solutions in the embodiments of the present application will be clearly and completely described with reference to the accompanying drawings. Obviously, the embodiments described are only a part of the embodiments of the present application, not all of them. Based on the embodiments in this application, all other embodiments obtained by those skilled in the art without creative work are within the protection scope of this application.

To further understand the content of this application, please refer to the attached drawings for a detailed description of this application.

Referring to FIGS. 1-6, a convenient meal box sealing machine for use in the present application includes a machine body 1, and a control panel (not labeled in the figure) is provided at a front end of the machine body 1. The heating time and temperature of the sealing machine can be adjusted through the control panel. There is a sealing groove 26 on a top of the machine body 1, and a sealing film groove 3 is provided on a left side of the sealing groove 26. The sealing film groove 3 is configured to place a sealing film roll. There is a cutting groove (not marked in the figure) on an outside of the sealing film groove 3, and the cutting groove corresponds to a blade 7. The sealing film is cut by sliding the blade 7 in the cutting groove. A meal box groove 2 is provided in a middle of the sealing groove 26 to limit a position of the meal box. A top of the sealing film groove 3 is provided with a film cutting component, and a rear of a top of the machine body 1 is connected to a sealing cover 8 for rotation. The sealing cover 8 is configured to drive the sealing plate 11 to move. There is a through groove 10 on an inner side of the sealing cover 8, and a cavity (not labeled in the figure) is provided inside the sealing cover 8, the cavity is communicated to the through groove 10. The through groove 10 is communicated to an interior of the sealing cover 8, and a sealing plate 11 is slidably connected inside the through groove 10. The sealing plate 11 facilitates the sealing of the meal box. All four sides of the sealing plate 11 are fixedly connected with two connection blocks 12, and the connection blocks 12 play a connecting role. The connection blocks 12 penetrate and are slidably connected to the limit column 13. A bottom of the limit column 13 is fixedly connected to an inner wall of the sealing cover 8, and a top of the limit column 13 is fixedly connected to a gasket (not labeled in the figure) through screws. A bottom of the limit column 13 is fixedly connected to an inner side of the sealing cover 8, and there is a screw hole on a top for easy placement of the spring into the limit column 13. The gasket is placed on a top of the limit column 13 and fixed with screws. The limit column 13 plays a role in limiting and guiding. An outer side of the sealing plate 11 is fixedly connected with a sealing plate silicone 15. The outer side of the sealing plate 11 is provided with a groove, and the sealing plate silicone 15 is provided in a groove of the outer side of the sealing plate 11 to cover a high-temperature adhesive tape 17 at an edge of the sealing plate 11. A heating wire 16 is fixedly connected to the outer side of the sealing plate 11, and a mica partition plate (not labeled in the figure) is provided on the outer side of the sealing plate 11 for insulation, and the heating wire 16 is provided on the mica partition plate. The heating wire 16 is provided with two types: wide-voltage heating wire and high-pressure heating wire. An input voltage of the wide-voltage heating wire is 12V, with a heating power of about 150 W, and an input voltage of the high-pressure heating wire is 100-240V, with a heating power of about 150 W. The two are the same shape and are designed to fit a heat-sealed edge of the meal box. There are fixed connection pins on two sides of the heating wire 16 of the meal box. The mica partition and sealing plate have corresponding slots for the heating wire 16 connection wire to pass through. Then, the heating wire 16 connection wire can be inserted into a hole of a rotating shaft position of the machine body 1 and the sealing cover 8, and then plugged into the corresponding terminal of a power board. There are two sealing modes through the heating wire 16: preheating sealing: before sealing the meal box, the machine starts and the heating wire 16 runs. After the heating wire 16 reaches a preset temperature, the machine sealing cover 8 is fastened to make the heating wire 16 contact the meal box and sealing film, and the meal box is sealed. After reaching the preset heating time, the heating wire 16 stops heating and the machine is completed. The sealing cover 8 is opened to take out the meal box. Direct sealing: the sealing cover 8 is closed and it is kept closed, the machine is start, the heating wire 16 runs to seal the meal box. After reaching the preset heating time, the heating wire 16 stops heating, and the machine is completed. The sealing cover 8 is opened to take out the meal box. The heating wire 16 is provided with the high-temperature adhesive tape 17 on an outside, and the high-temperature adhesive tape 17 is fixedly connected to the sealing plate 11. The sealing cover 8 has an expansion groove 20 on an outside, and a push block 21 is connected inside the expansion groove 20 for easy installation. There is a slotting 23 on an inner side of the sealing cover 8, and the slotting 23 is communicated to the expansion slot 20. The slotting 23 facilitates the movement of the clamp block 22. The slotting 23 is penetrated and provided with a clamp block 22, and the clamp block 22 is fixedly connected to the push block 21. An outer side of the clamp block 22 is in a hook shape, which serves as a limit.

Figure 2:
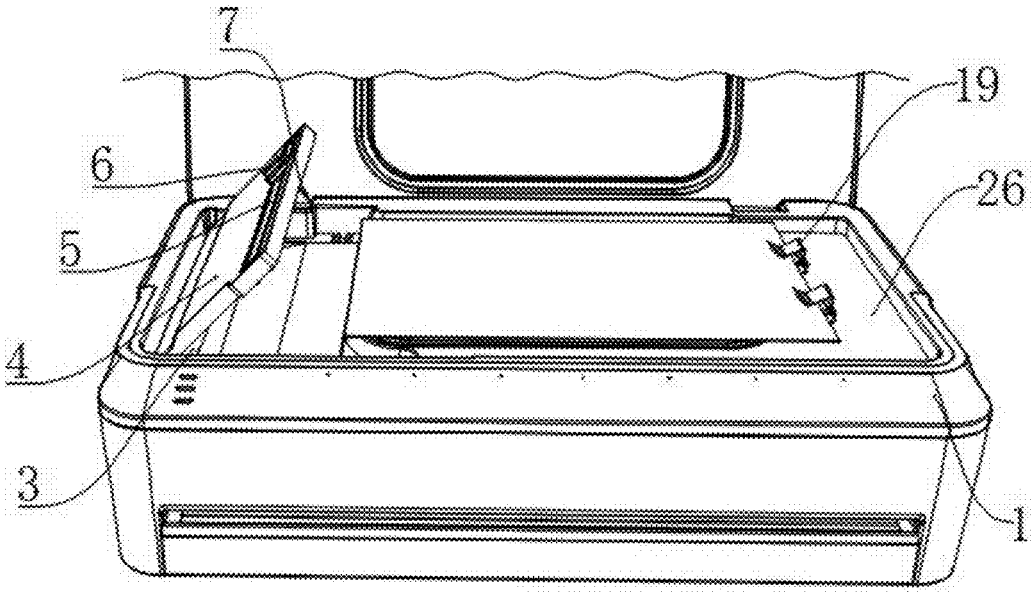
FIG. 2 is a schematic structural diagram of a film cutting component of the present application.
Figure 3:
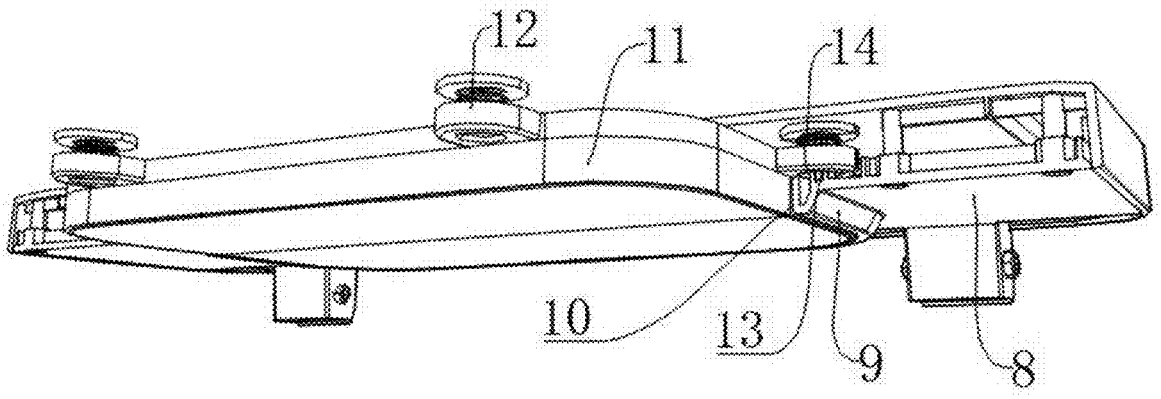
FIG. 3 is a schematic structural diagram of a sealing plate of the present application.
Figure 4:
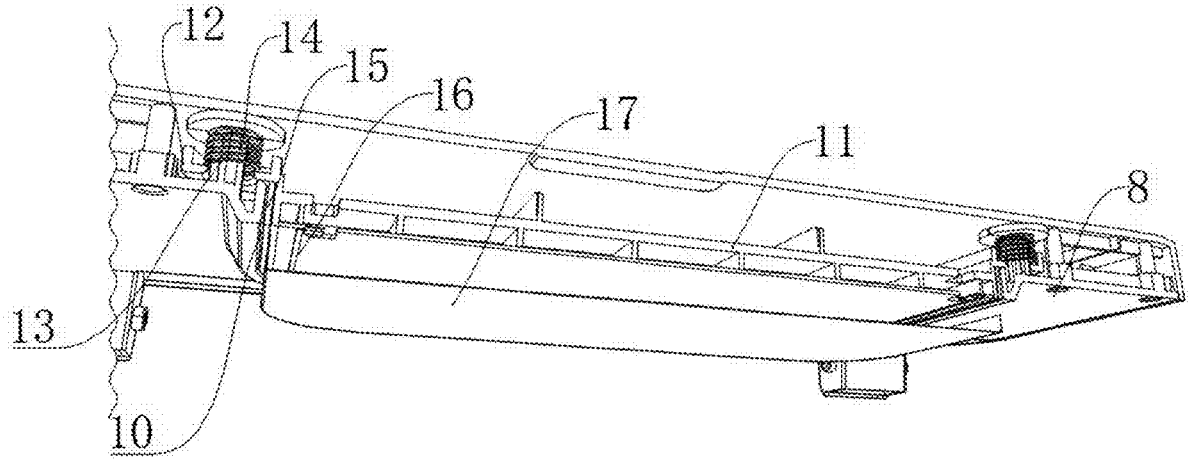
FIG. 4 is a sectional view of the sealing plate of the present application.
Figure 5:
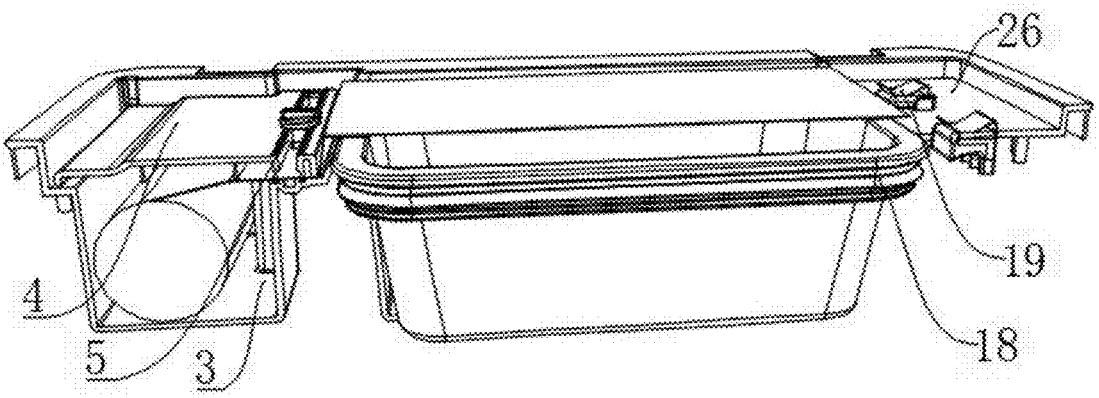
FIG. 5 is a schematic structural diagram of a sealing groove of the present application.
Figure 6:
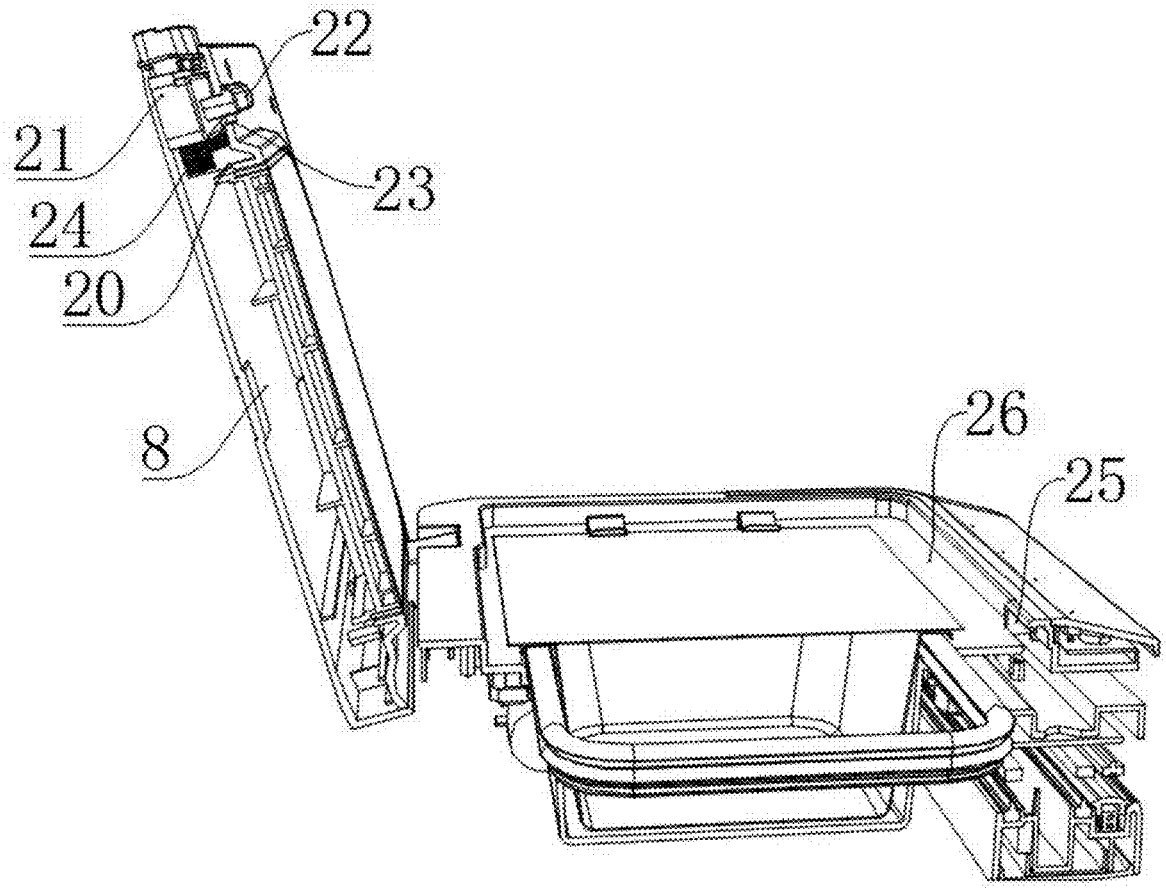
FIG. 6 is a sectional view of the overall structure of the present application.

Referring to FIG. 2, the film cutting component includes a movable cover 4, and the movable cover 4 is provided with a locking buckle (not labeled in the figure) for opening or closing the movable cover 4. The movable cover 4 is rotatably connected to a left side of the sealing film groove 3. The movable cover 4 is penetrated and provided with a movable groove 5. A sliding seat 6 is slidably connected inside the movable groove 5, and the blade 7 is fixedly connected to a bottom of the sliding seat 6. The film cutting component can facilitate linear cutting of the sealing film covering an upper part of the meal box.

Referring to FIGS. 1-6, an outer side of the through groove 10 is provided with a protruding ring 9, and the protruding ring 9 is fixedly connected to the sealing cover 8. The sealing film can be limited by the protruding ring 9 when the sealing cover 8 is closed. Above an outer side of the limit column 13, there is a first spring 14, and the first spring 14 is provided between the connection blocks 12 and the gasket. The first spring 14 is provided between the connection blocks 12 and the gasket fixed at a top of the limit column 13. The contraction of the first spring 14 enables the sealing plate 11 to move up and down, resulting in a better sealing effect on the meal box. An outer side of the meal box groove 2 is provided with a meal box support silicone 18, and the meal box support silicone 18 is fixedly connected to the sealing groove 26. The meal box support silicone 18 can support and limit edges of the meal box, and facilitate the sealing of the meal box. There are two sealing clips 19 fixedly connected to a right side of the sealing groove 26, the sealing clips 19 can limit the sealing film. There are two second springs 24 fixedly connected to an inner side of the push block 21, and the second springs 24 are fixedly connected to an inner wall of the expansion groove 20. The push block 21 can be extended and retracted through the second springs 24. A clamp slot 25 is provided at a front end of the sealing groove 26, and the clamp slot 25 corresponds to the clamp block 22. By matching the clamp block 22 with the clamp slot 25, the sealing cover 8 can be firmly locked to the machine body 1, thereby avoiding accidental opening of the sealing cover 8 during the sealing process and affecting the sealing effect.

Working principle: when in use, the meal box is first placed to be sealed into the meal box groove 2. The meal box support silicone 18 on the outer side of the meal box groove 2 is tightly attached to a top edge of the meal box, which plays a positioning role to prevent the meal box from shifting during subsequent operations. The movable cover 4 connected to the left side of the sealing film groove 3 is opened, the rolled sealing film is placed in the sealing film groove 3, the movable cover 4 is closed, and then one end of the sealing film is pulled out to cover an opening of the meal box. Next, using the sealing groove, a free end of the sealing film is clamped and secured with the two sealing clips 19 fixed on the right side of sealing groove 26, ensuring that the sealing film remains flat and does not shift during subsequent cutting and sealing processes. The sealing film is cut according to the size requirements of the meal box. The sliding seat 6 connected to the movable groove 5 is pushed inside the movable cover 4. The blade 7 fixedly connected to the bottom of the sliding seat 6 will slide synchronously with the movement of the sliding seat 6. The blade 7 contacts the sealing film and it is cut to obtain a sealing film that matches the opening size of the meal box. After cutting, the sliding seat 6 is reset to its initial position. The sealing cover 8 is closed and it is rotated towards the sealing groove 26. During the process of closing the sealing cover 8, the push block 21 is pressed inside the outer expansion groove 20 of the sealing cover 8. The push block 21 drives the clamp block 22 fixedly connected to it to move towards an inner side of the expansion groove 20. At the same time, the two second springs 24 fixedly connected the inner side the push block 21 are compressed. After the sealing cover 8 is completely closed, the push block 21 is released. Under the elastic reset action of the second spring 24, the push block 21 drives the clamp block 22 to pop out along the slotting 23, and the clamp block 22 is inserted into the corresponding clamp slot 25 at the front end of the sealing groove 26, thereby achieving a firm lock between the sealing cover 8 and the machine body 1, avoiding accidental opening of the sealing cover 8 during the sealing process and affecting the sealing effect. After the sealing cover 8 is locked, the sealing plate 11 and the high-temperature adhesive tape 17 are connected to the meal box and the sealing film. When the sealing plate 11 is compressed, it slides upward along the limit column 13 through the connection blocks 12 on the outer side of the sealing plate 11 to press the first spring 14. The sealing plate 11 can expand and contract within the through groove 10, and the high-temperature adhesive tape 17 on the outside of the sealing plate 11 is tightly adhered to the sealing film covering the opening of the meal box; the power supply of the sealing machine is started, and the heating wire 16 fixedly connected to the outer side of the sealing plate 11 starts to be powered on and generate heat. The heating wire 16 heats a contact area between the sealing film and the opening edge of the meal box, the sealing film is caused to melt and tightly adhere to the opening edge of the meal box. The heating process continues until the preset sealing time, ensuring that the sealing film is completely sealed with the meal box. After the sealing is completed, the equipment automatically shuts off, and the heating wire stops heating, the push block 21 is pressed again to release the clamp block 22 from the clamp slot 25, a locking state between the sealing cover 8 and the machine body 1 is released, and then the sealing cover 8 is rotated upwards to open it.

It should be noted that in this specification, relational terms such as first and second are only used to distinguish one entity or operation from another, and do not necessarily require or imply any actual relationship or order between these entities or operations. Moreover, the terms "including", "containing", or any other variation thereof are intended to encompass non-exclusive inclusion, such that a process, method, item, or device that includes a series of elements includes not only those elements, but also other elements not explicitly listed, or elements inherent to such process, method, item, or device.

Although the embodiments of the present application have been shown and described, it will be understood by those skilled in the art that various changes, modifications, substitutions, and variations can be made to these embodiments without departing from the principles and spirit of the present application. The scope of the present application is limited by the appended claims and their equivalents.

What is claimed is:

1. A convenient meal box sealing machine, comprising: a machine body, wherein a top of the machine body is provided with a sealing groove, a left side of the sealing groove is provided with a sealing film groove, a middle of the sealing groove is provided with a meal box groove, and a top of the sealing film groove is provided with a film cutting component;

the top of the machine body is rotatably connected to a sealing cover, and an inner side of the sealing cover is provided with a through groove;

the through groove is communicated to an interior of the sealing cover;

the through groove is slidably connected to a sealing plate, and four sides of the sealing plate are fixedly connected to connection blocks;

the connection blocks penetrate and are slidably connected to a limit column, a bottom of the limit column is fixedly connected to an inner wall of the sealing cover, and a top of the limit column is fixedly connected with a gasket, and an outer side of the sealing plate is fixedly connected with a sealing plate silicone;

the outer side of the sealing plate is fixedly connected with a heating wire, an outer side of the heating wire is provided with a high-temperature adhesive tape, and the high-temperature adhesive tape is fixedly connected to the sealing plate; an outer side of the sealing cover is provided with an expansion groove, and a push block is connected inside the expansion groove;

the inner side of the sealing cover is provided with a slotting.

2. The convenient meal box sealing machine according to claim 1, wherein the film cutting component comprises a movable cover, and the movable cover is rotatably connected to the left side of the sealing groove, a movable groove is penetrated and provided inside the movable cover;

a sliding seat is slidably connected inside the movable groove, and a blade is fixedly connected to a bottom of the sliding seat.

3. The convenient meal box sealing machine according to claim 1, wherein an outer side of the through groove is provided with a protruding ring, and the protruding ring is fixedly connected to the sealing cover.

4. The convenient meal box sealing machine according to claim 1, wherein a first spring is sleeved above an outer side of the limit column, and the first spring is provided between the connection blocks and the gasket.

5. The convenient meal box sealing machine according to claim 1, wherein an outer side of the meal box groove is provided with a meal box support silicone, and the meal box support silicone is fixedly connected to the sealing groove.

6. The convenient meal box sealing machine according to claim 1, wherein a sealing clip is fixedly connected to a right side of the sealing groove.

7. The convenient meal box sealing machine according to claim 1, wherein a second spring is fixedly connected to an inner side of the push block, and the second spring is fixedly connected to an inner wall of the expansion groove.

8. The convenient meal box sealing machine according to claim 1, wherein a clamp slot is provided at a front end of the sealing groove, and the clamp slot corresponds to a clamp block.

9. The convenient meal box sealing machine according to claim 8, wherein the slotting is communicated to the expansion groove, and the clamp block is inserted and provided inside the slotting, and the clamp block is fixedly connected to the push block.

* * * * *